US010152955B2

(12) United States Patent
Sikra

(10) Patent No.: US 10,152,955 B2
(45) **Date of Patent: *Dec. 11, 2018**

(54) PERCUSSION PEDAL ASSEMBLY

(71) Applicant: Drum Workshop, Inc., Oxnard, CA (US)

(72) Inventor: Richard A Sikra, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/583,173

(22) Filed: May 1, 2017

(65) Prior Publication Data

US 2017/0236503 A1 Aug. 17, 2017

Related U.S. Application Data

(63) Continuation of application No. 15/002,264, filed on Jan. 20, 2016, now Pat. No. 9,640,154.

(60) Provisional application No. 62/106,661, filed on Jan. 22, 2015, provisional application No. 62/106,144, filed on Jan. 21, 2015.

(51) Int. Cl.

| | |
|---|---|
| ***G10D 13/02*** | (2006.01) |
| ***G10D 13/00*** | (2006.01) |
| ***G10D 13/06*** | (2006.01) |

(52) U.S. Cl.
CPC ..... *G10D 13/006* (2013.01); *G10D 13/065* (2013.01)

(58) Field of Classification Search
CPC ..... G10D 13/006; G10D 13/065
See application file for complete search history.

(56) References Cited

U.S. PATENT DOCUMENTS

| | | | | |
|---|---|---|---|---|
| 1,042,904 A * | 10/1912 | Fraser | G10D 13/006 84/422.2 |
| 1,042,919 A | 10/1912 | Hughes | 84/422.2 |
| 2,132,211 A * | 10/1938 | Hueckstead | G10D 13/006 84/422.1 |
| 3,147,661 A | 9/1964 | Padera | |
| 3,530,757 A | 9/1970 | Osiga | |
| 3,797,356 A | 3/1974 | Duffy et al. | |
| 4,145,951 A * | 3/1979 | Kobayashi | G10D 13/065 84/422.3 |

(Continued)

OTHER PUBLICATIONS

U.S. Appl. No. 14/506,350, filed Oct. 3, 2014, Sikra.

(Continued)

*Primary Examiner* — Robert W Horn
(74) *Attorney, Agent, or Firm* — Ferguson Case Orr Paterson LLP

(57) ABSTRACT

Drum pedal assemblies are disclosed which can include one or more adjustment features. Adjustment features which can be included in embodiments of the present disclosure can include components for adjusting pedal angle and/or height, and the resistance offered by the pedal (such as due to a spring connection). Pedal assemblies according to some embodiments of the present disclosure can include rotatable base plates for easy storage and travel. Pedal assemblies according to some embodiments the present disclosure can include securing means such as retractable spikes for stabilizing the pedal assembly.

23 Claims, 5 Drawing Sheets

(56) References Cited

U.S. PATENT DOCUMENTS 4,198,894 A * 4/1980 Della-Porta ..... G10D 13/006 84/422.1
4,200,025 A * 4/1980 Currier ..... G10D 13/006 84/422.1
4,449,440 A * 5/1984 Hoshino ..... G10D 13/065 84/422.3
4,488,471 A 12/1984 Youakim
4,517,876 A * 5/1985 Duhon ..... G10D 13/065 84/421
4,667,562 A 5/1987 Lee
4,756,224 A 7/1988 Lombardi ..... 84/422.1
4,846,040 A 7/1989 Hoshino
4,976,181 A 12/1990 Hsieh
4,977,810 A 12/1990 Hsieh
5,090,289 A 2/1992 Holcomb
5,192,822 A * 3/1993 Hoshino ..... G10D 13/065 84/421
5,251,528 A 10/1993 Kurosaki
5,301,592 A 4/1994 Johnson
5,557,054 A 9/1996 Shigenaga ..... 84/422.1
5,646,360 A 7/1997 Liao ..... 84/422.1
5,789,688 A 8/1998 Schiano
5,945,616 A 8/1999 Hoshino
6,003,822 A 12/1999 Kurosaki
6,031,170 A 2/2000 Hoshino
6,229,080 B1 * 5/2001 Ishimatsu ..... G10D 13/065 84/422.1
6,271,450 B1 8/2001 Mackie
6,278,046 B1 8/2001 Sikra
6,329,584 B1 12/2001 Liao
6,359,205 B1 3/2002 Lombardi ..... 84/422.1
6,399,865 B1 6/2002 Ishimatsu
6,570,076 B1 5/2003 Kjellgren ..... 84/422.1
6,573,443 B1 6/2003 Chen ..... 84/422.1
6,590,147 B2 7/2003 Kassabian ..... 84/422.1
6,689,945 B1 2/2004 Matsuzoe ..... 84/422.1
6,747,200 B2 6/2004 Sato
6,762,354 B2 7/2004 Cocca
6,822,149 B1 11/2004 Liao ..... 84/422.1
6,894,210 B1 5/2005 Lombardi
6,906,252 B2 6/2005 Matsuzoe ..... 84/422.1
6,930,232 B2 * 8/2005 Shigenaga ..... G10D 13/065 84/422.3
7,071,400 B1 7/2006 Lomberdi ..... 84/402
7,301,088 B2 11/2007 Chen
7,371,953 B2 5/2008 Takegawa
7,405,352 B2 * 7/2008 Dorfman ..... G10D 13/006 84/225
7,449,626 B2 * 11/2008 Chen ..... G10D 13/006 84/422.1
7,456,351 B2 11/2008 Dorfman ..... 84/422.1
7,511,212 B1 3/2009 Chang
7,633,000 B2 12/2009 Dorfman
7,671,262 B1 3/2010 Lin
7,737,352 B2 6/2010 Chang
7,956,268 B1 6/2011 Liao
8,063,293 B1 11/2011 Kjellgren
8,076,562 B1 12/2011 Lin ..... 84/422.1
8,278,541 B2 10/2012 Dorfman ..... 84/422.1
8,410,346 B2 4/2013 Sassmannshausen ..... 84/422.1
8,455,746 B2 6/2013 Johnson et al.
8,735,705 B1 * 5/2014 Chen ..... G10D 13/006 84/422.1
8,859,870 B2 10/2014 Yamane
8,946,531 B2 2/2015 Nakata
8,993,865 B2 3/2015 Liao
9,460,692 B2 * 10/2016 Chen ..... G10D 13/006
9,466,272 B1 * 10/2016 Lin ..... G10D 13/006
9,472,174 B2 10/2016 Sikra
9,640,154 B2 * 5/2017 Sikra ..... G10D 13/006
2003/0209128 A1 11/2003 Hsieh
2004/0060421 A1 4/2004 Yun
2005/0150354 A1 7/2005 Paul ..... 84/422.1
2006/0169124 A1 8/2006 Tanaka
2007/0044637 A1 3/2007 Kjellfren ..... 84/422.1
2008/0195574 A1 8/2008 Kjellgren ..... 84/422.1
2008/0245210 A1 10/2008 Chang
2011/0067552 A1 3/2011 Chen ..... 84/412
2014/0182445 A1 * 7/2014 Liao ..... G10D 13/006 84/422.1
2015/0082968 A1 3/2015 Sikra
2015/0187343 A1 7/2015 Mori ..... 84/746
2016/0063973 A1 * 3/2016 Lemieux ..... G10D 13/006 84/422.1
2016/0210946 A1 7/2016 Sikra
2017/0124993 A1 * 5/2017 Sikra ..... G10D 13/006
2017/0236503 A1 * 8/2017 Sikra ..... G10D 13/006 84/422.1

OTHER PUBLICATIONS

U.S. Appl. No. 13/663,655, filed Oct. 30, 2012, Sikra.
U.S. Appl. No. 61/882,538, filed Sep. 25, 2013, Sikra.
U.S. Appl. No. 61/899,762, filed Nov. 4, 2013, Sikra.
DWCP3500 "Hi-Hat Stand" from Drum Workshop, Inc. available online at www.dwdrums.com, downloaded Feb. 3, 2015.
International Search Report and Written Opinion from Appl. No. PCT/US14/57383, dated Dec. 17, 2014.
DW Drums, DW 9000 Pedal Upgrades—Artist Testimonials, Youtube: Video (online). Nov. 5, 2012 (retrieved Mar. 15, 2017), Retrieved from the Internet: https://www.youtube.com/watch?v=B9zKsz93PVk>: 6:0093:13.
International Search Report and Written Opinion from patent appl. No. PCT/US17/13991, dated Apr. 6, 2017.

* cited by examiner

PERCUSSION PEDAL ASSEMBLY

This application is a continuation of U.S. patent application Ser. No. 15/002,264 to Sikra, filed on Jan. 20, 2016, which claims the benefit of U.S. Provisional Patent Application 62/106,144 to Sikra, filed on Jan. 21, 2015, and claims the benefit of U.S. Provisional Patent Application 62/106,661 to Sikra, filed on Jan. 22, 2015. Each of the above applications is fully incorporated by reference herein in its entirety.

BACKGROUND OF THE INVENTION

Field of the Invention

This invention relates generally to drum/cymbal pedal assemblies that can connect to drums and/or cymbals, such as hi-hat systems, and more particularly to pedal assemblies with features that can adjust the tension, resistance, and/or delay time that a user experiences upon actuating the pedal.

Description of the Related Art

A hi-hat is a common component of a drum set that can include two cymbals facing one another and mounted on a vertical tube or pole. A hi-hat can be operated in many different ways, including by a foot pedal which can cause the cymbals to strike one another, or by actuation using a drum stick, among other operation methods. The top and/or bottom cymbal can be adjustable so as to be mounted at different heights; in many prior art systems, the height of the top cymbal is adjustable. Adjustable cymbals can be attached to the tube using a clutch, which can aid in adjusting the cymbal height. Some exemplary clutches are described, for example, in U.S. patent application Ser. No. 14/506,350 to Sikra, filed on Oct. 3, 2014, which is fully incorporated by reference herein in its entirety. Either cymbal can be adjusted so as to be, for example, separated from the other cymbal, to be in loose contact with the other cymbal, or to be in tight contact with the other cymbal.

Pedal assemblies are used as a mechanism with which a drummer can strike a drum and/or a cymbal, such as a hi-hat, with his or her feet, thus allowing the drummer's hands to be free for use with other instruments. Variations in drummer technique mean that it is very difficult to design a single pedal assembly to meet the needs of every drummer. Such variables can include desired drumming speed, foot force, and/or desired strike point, among other variables.

Adjustable pedals can provide the customization necessary to achieve some or all of a drummer's desired pedal characteristics. Some pedals with adjustable features are described in U.S. Pat. Nos. 5,301,592 and 8,455,746 to Johnston and U.S. Pat. No. 6,590,147 to Kassabian, each of which is fully incorporated by reference herein in its entirety. However, adjustment mechanisms provided in the prior art can be unwieldy, which can increase difficulty to the user, and/or can lack adjustability of a variable which is independent of other variables, thus reducing the amount of customization available via adjustments.

Accordingly, there is a present need for a novel and efficient design for a pedal assembly for use with percussion instruments such as hi-hats which specifically addresses the aforementioned problems.

SUMMARY OF THE DISCLOSURE

The present disclosure relates to drum pedal assemblies for use with an instrument, such as a hi-hat. The pedal assembly can include various adjustable features such that a user can alter the operation of the pedal assembly to fit his or her needs and playing style.

One embodiment of a pedal assembly according to the present disclosure can include a pedal, and a spring operably connected to the pedal. A first spring tensioning feature can be operable to adjust the length of the spring mechanism.

Another embodiment of a pedal assembly according to the present disclosure can include a base plate and a pedestal, and a pedal on the base plate. The base plate can be rotatable relative to the pedestal.

Yet another embodiment of a pedal assembly according to the present disclosure can include a pedestal assembly and a pedal connected to the pedestal assembly. Securing means can be attached to the pedestal assembly to interact with an object or surface thereunder.

Yet another embodiment of a pedal assembly according to the present disclosure can include a pedestal assembly, pedal, and spring mechanism operably linked to the pedal. A rigid link member can be between the pedal and spring mechanism. A bracket can be attached to the pedestal assembly, and can include a portion between the link member and the spring. The position of the bracket can be adjustable.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further features and advantages, will be better understood from the following description when considered in connection with the accompanying figures. It is to be expressly understood, however, that each of the figures is provided for the purpose of illustration and description only and is not intended as a definition of the limits of the present disclosure.

DETAILED DESCRIPTION OF THE INVENTION

Figure 1:
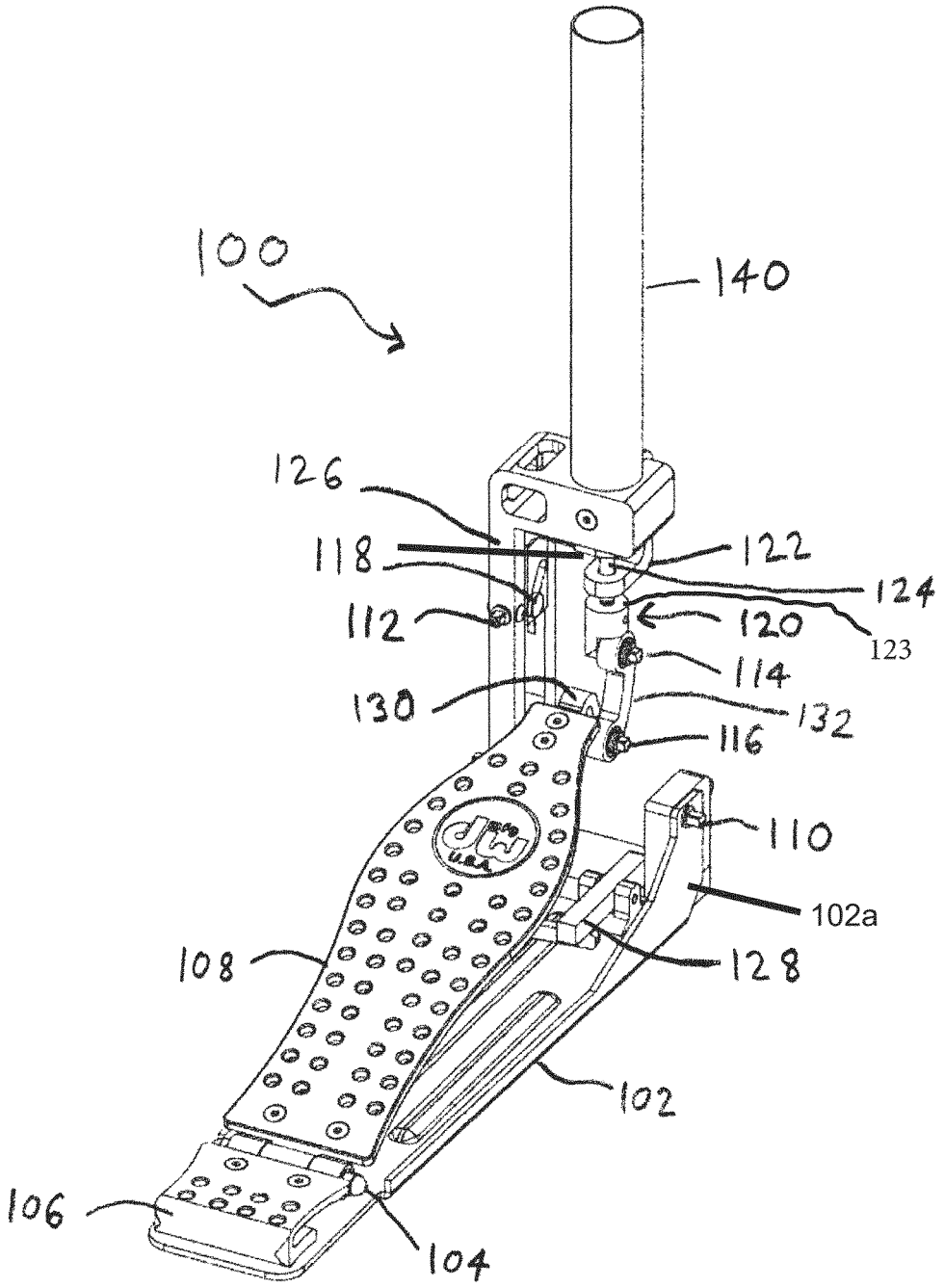
FIG. 1 is a perspective view of one embodiment of pedal assembly 100 according to the present invention.

The present invention relates to a drum and/or cymbal beating devices and assemblies, such as a pedal device for use with a hi-hat. While pedal assemblies described herein may be described in certain cases as "hi-hat pedal assemblies," it is understood that these pedal assemblies can be modified to fit other uses such as with other percussion instruments, or that concepts described with regard to a hi-hat pedal assembly can be incorporated into other types of pedal assemblies. The hi-hat pedal assembly according to the present invention can include various adjustment features and/or interlocking features. The adjustment features can adjust the tension and/or resistance a user experiences when actuating the pedal, the rebound characteristics of the pedal as it returns to its rest position after an actuation, and/or the inclination angle of the pedal. Moreover, the adjustment features can cause the pedal assembly to become collapsible. The hi-hat pedal assembly can also include a flexible heel plate attached to a base and/or pedal. Additionally, the hi-hat pedal assembly can include interconnection features such as tab/slot combinations for connecting two or more parts of the device. These tab/slot combinations can reduce or eliminate undesired movements. Such interconnection features are described in U.S. patent application Ser. No. 14/495,718 to Sikra, which is fully incorporated by reference herein.

Throughout this disclosure, the preferred embodiment and examples illustrated should be considered as exemplars, rather than as limitations on the present invention. As used herein, the terms "invention," "device," "apparatus," "method," "present invention," "present device," "present apparatus" or "present method" refers to any one of the embodiments of the invention described herein, and any equivalent and similar embodiments. Furthermore, reference to various feature(s) of the "invention," "device," "apparatus," "method," "present invention," "present device," "present apparatus" or "present method" throughout this document does not mean that all claimed embodiments or methods must include the referenced feature(s).

It is also understood that when an element or feature is referred to as being "on" or "adjacent" to another element or feature, it can be directly on or adjacent the other element or feature or intervening elements or features may also be present. In contrast, when an element is referred to as being "directly on" or extending "directly onto" another element, there are no intervening elements present. Additionally, it is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Furthermore, relative terms such as "inner," "outer," "upper," "top," "above," "lower," "bottom," "beneath," "below," and similar terms, may be used herein to describe a relationship of one element to another. Terms such as "higher," "lower," "wider," "narrower," and similar terms, may be used herein to describe angular relationships. It is understood that these terms are intended to encompass different orientations of the elements or system in addition to the orientation depicted in the figures.

Although the terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention. As used herein, the term "and/or" includes any and all combinations of one or more of the associated list items.

The terminology used herein is for the purpose of describing particular embodiments only and is not intended to be limiting of the invention. As used herein, the singular forms "a," "an," and "the" are intended to include the plural forms as well, unless the context clearly indicates otherwise. For example, when the present specification refers to "an" assembly, it is understood that this language encompasses a single assembly or a plurality or array of assemblies. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

It is understood that while the present disclosure makes reference to pedal assemblies for use with percussion assemblies, such as hi-hats, and that pedal assemblies for drums and/or cymbal assemblies are the primary application concerned with the present disclosure, devices incorporating features of the present invention can be utilized with any application.

Embodiments of the invention are described herein with reference to view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region and are not intended to limit the scope of the invention.

FIG. 1 is a perspective view of one embodiment of a pedal assembly 100 according to the present invention, which can be a hi-hat pedal assembly. The hi-hat pedal assembly 100 can comprise a base plate 102, hinge piece 104, heel plate 106, and pedal 108. The hi-hat pedal assembly 100 can also comprise several different drum key screws or rotatable members, including the drum key screws or rotatable members 110, spring tension screw or drum key screw 112, drum key screw or rotatable member 114, and/or drum key screw or rotatable member 116. It is understood that while the phrase "drum key screw" in places throughout this disclosure, any similar connecting/attachment/fastening mechanism including but not limited to rotatable members can be used in place of a drum key screw. Further, while the specific embodiments shown herein include base plates, such as the base plate 102, it is understood that embodiments of the present invention without base plates are possible. For example, instead of a base plate, embodiments of pedal assemblies according to the present invention can include a heel plate connected to a pedestal assembly via rods or similar structures. One example of an assembly not incorporating a base plate, for example, is the DWCP3500 Hi-Hat Stand, available from Drum Workshop, Inc. of Oxnard, Calif., U.S.A. Such assemblies not having a base plate can include the other components, features, and/or capabilities of embodiments of the present invention described herein.

The hi-hat pedal assembly 100 can comprise a spring assembly such as the spring assembly 118 shown in FIG. 1. The spring assembly 118 can be connected to a spring (not shown) and/or a spring bushing (not shown), such as a compression spring. The spring assembly 118 can be, for example, the same as or similar to the spring assembly 218 shown in FIGS. 4 and 5, including a spring bushing and a spring. The spring assembly 118 can include a substantially vertical portion, a substantially horizontal portion, a spring bushing on the substantially horizontal portion, and a spring on the spring bushing and/or substantially horizontal portion. The spring bushing and/or spring can be partially or fully within hi-hat piping 140. It is understood that in certain embodiments of the present invention, the spring may be above and/or rest on the spring bushing, and in other embodiments the spring may be above and/or on the horizontal portion of the spring assembly. Embodiments without a spring bushing are also possible, and many different shapes of spring assemblies are possible.

The hi-hat pedal assembly 100 can also comprise a bracket 122, rod 124, and pedestal 126, which can itself include a pedestal baseplate 126*a*. The bracket 122 can be adjustable, such as but not limited to vertically adjustable, and/or can be slidable, or in other embodiments may or may not be capable of movements including but not limited to sliding. Additionally, the bracket 122 can take many different shapes, including but not limited to an "L" shape "C" shape. Additionally, the hi-hat pedal assembly 100 can comprise a clamp locking assembly 128, pedal attachment mechanism 130, link member 132, and the hi-hat tubing 140. It is understood that different combinations of these and other components, including combinations omitting some of the above components, are possible.

Figure 2:
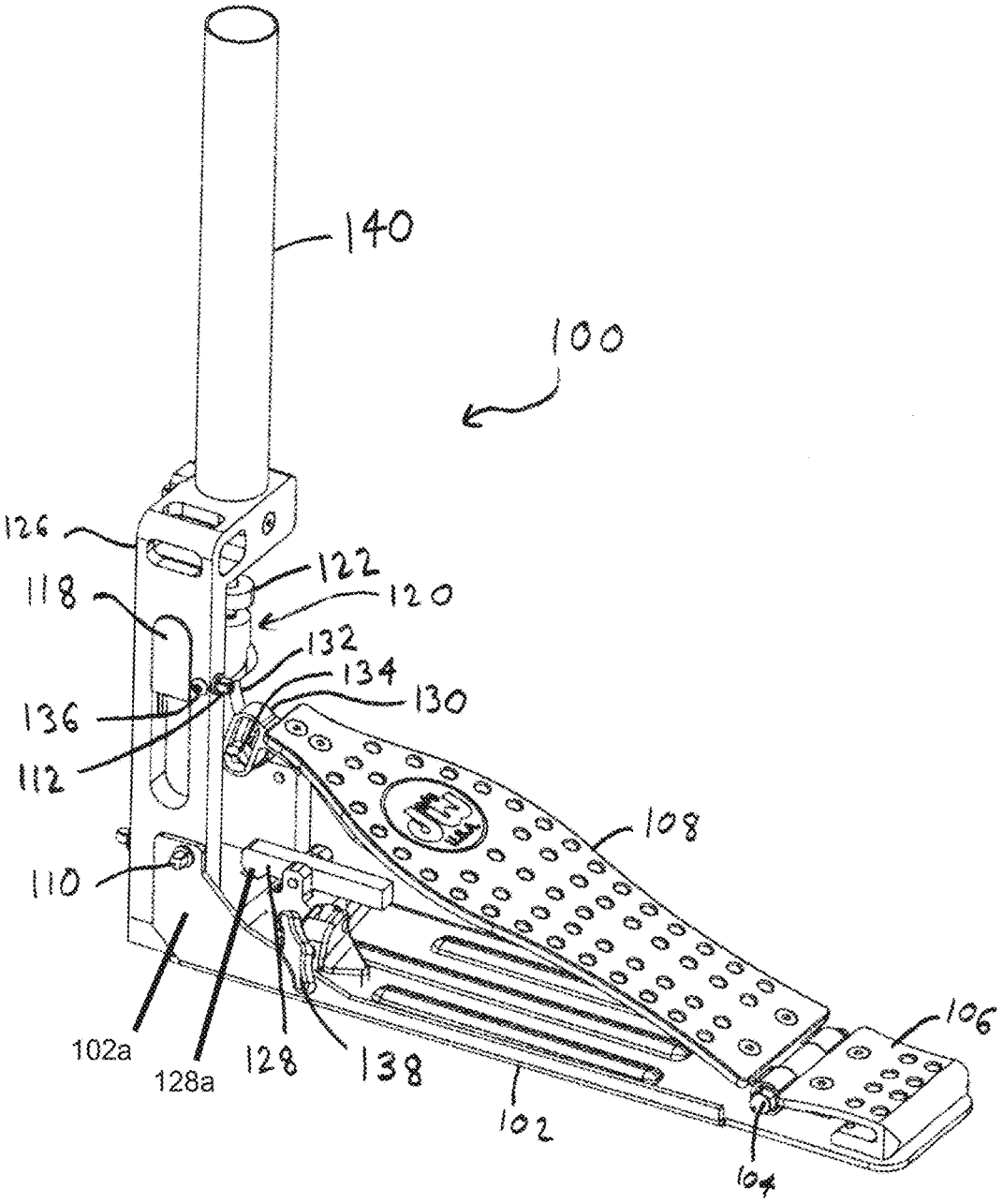
FIG. 2 is another perspective view of the pedal assembly 100 according to the present invention.
Figure 3:
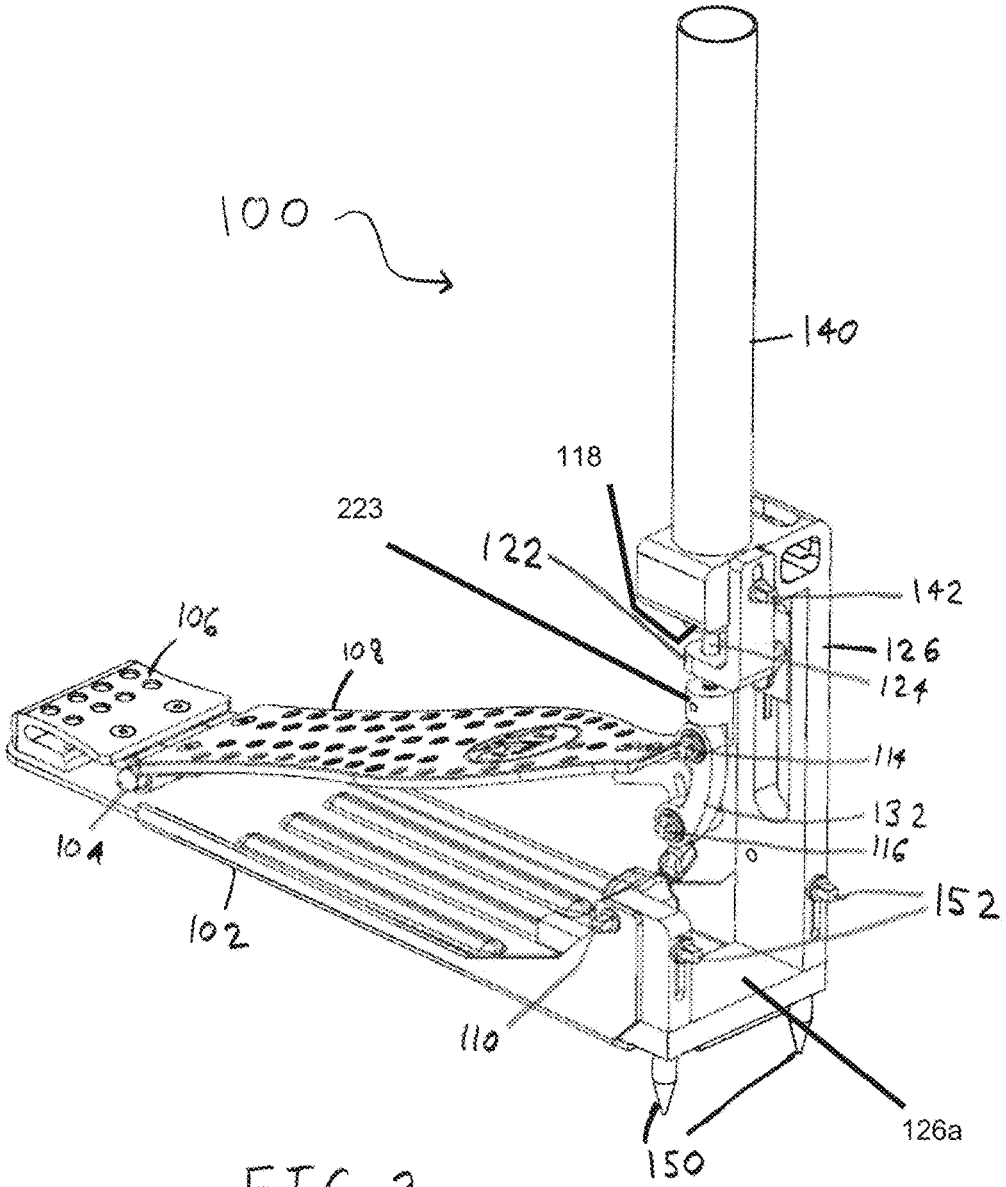
FIG. 3 is another perspective view of the pedal assembly 100 according to the present invention.

The hi-hat pedal assembly 100 can include the ability to rotate and/or collapse amongst itself for storing purposes. As shown in FIGS. 1-3, some embodiments of the present invention can include drum key screws 110, clamp locking assemblies such as the clamp locking assembly 128, and/or a clamp screw 138, all of which can work together to allow the base plate 102 to incline and/or decline. The clamp screw 138 can be loosened or tightened to control whether the clamp locking assembly 128 is in an open or a locked position. When in a locked position, a forward portion 128*a* of the clamping assembly 128 can be proximate the pedestal base plate 126*a*, in contact with the pedestal base plate 126*a*, and/or within an aperture of the pedestal base plate 126*a*. This placement of the clamping assembly 128 and/or the forward portion 128*a* can prevent rotation of the base plate 102 with respect to the pedestal 126. When in an option position, the forward portion 128*a* of the clamping assembly 128 can be raised further away from the pedestal base plate 126*a*. Placement of the forward portion 128*a* further away from the pedestal base plate 126*a* can enable rotation of the footboard 102 about the drum key screws 110.

Tightening of the drum key screws 110 can also prevent or make difficult movement of the base plate 102, even if the clamping assembly 128 is in an open position. When the clamp locking assembly 128 is in an open position, the base plate 102 can incline. If the clamp locking assembly 128 is in a locked position, and/or, in some embodiments, if the drum key screws 110 are tightened, then the base plate 102 cannot be inclined, or can be more difficult to incline. As such, the clamp locking assembly 128 and/or the drum key screws 110 can be operable to control the incline and/or decline of the base plate 102 as desired by the user.

When the base plate 102 inclines or declines, such as inclines or declines in a rotational manner, the pedal 108 can move and/or rotate along with the base plate 102. When the base plate 102 and pedal 108 are inclined, one or both of the base plate 102 and pedal 108 can align at angles of 45° or above, and/or in some embodiments at angles of 60° or above, and/or in some embodiments at angles of 75° or above, and/or in some embodiments at an angle of near 90° or 90°, such as at or near the same angle as the pedestal 126 and/or hi-hat tubing 140 so as to be approximately parallel with the pedestal 126 and/or hi-hat tubing 140. Drum key screws such as the drum key screws 110 can then be re-tightened to lock the base plate 102 and pedal 108 into a compact position, and/or to make rotation or movement of the base plate 102 relative to the pedestal 126 more difficult. This can allow the hi-hat pedal assembly 100 to become much easier to store and/or transport. To reverse the process, drum key screws 110 can be loosened so that the base plate 102 and/or pedal 108 can decline. Once the base plate 102 and/or the pedal 108 are declined, the clamp locking assembly 128 can be locked into position and/or the drum key screws 110 can be tightened, which can replicate the positioning shown in FIGS. 1-3.

While the above describes a locking/rotation system incorporating a single drum key screw 110 on each side of the pedal assembly 100, it is understood that further such mechanisms can be used. For example, another drum key screw can be included below each of the drum key screws 110, with these additional screws being placed within an aperture pathway of the base plate portions 102*a* (it is understood that while the base plate portions 102*a* are shown as portions of the base plate 102, embodiments where these portions are separate elements is also possible). Thus, when not tightened, rotation could be enabled about the drum key screws 110, and when tightened rotation could be prevented or made more difficult. It is understood that such mechanisms could be used with or without mechanisms previously described, such as, for example, the clamp locking assembly 128.

The direct drive assembly 120 can comprise a link member 132, bracket 122, and/or rod 124. While a direct drive assembly is shown in the specific embodiment of FIGS. 1-3, it is understood that other types of drive assemblies, such as chain drive assemblies, can be used in embodiments of the present invention. User movement of pedal 108 corresponds to movement of link member 132, bracket 122, and/or rod 124 in a generally downward direction. A cymbal can be mounted on the rod 124 and can form the top cymbal of a hi-hat assembly, such that actuation of the pedal 108 causes the rod 124 and cymbal to move downward such that the top cymbal impacts the bottom cymbal. As displayed in FIG. 1, the link member 132, bracket 122, and/or rod 124 can all be connected to one another. The rod 124 can extend up and into hi-hat tubing 140.

The direct drive assembly 120 can be configured such that the hi-hat pedal assembly 100 can be played in a manner such that other components of the pedal assembly 100 immediately respond or nearly immediately responds to user movement of the pedal 108, with little or no rebound after the pedal assembly has returned to its resting position. One factor in one such configuration is that the linking member 132 is rigid, such as metal. In hi-hat pedals known in the art, a chain is often used to pull the hi-hat cymbals together. However, a chain has "flop" or "give," which can result in a delay or lag time once the user moves a pedal (and/or in the resulting return of the pedal to its resting position). As such, the direct drive assembly 120 of the present invention can allow a user to play with no, little, and/or reduced flop or give. While in some embodiments, the link member 132, bracket 122, and/or rod 124 are all rigid components that work in conjunction to allow the present invention to be played with no, little, and/or reduced delay or lag time, it is understood that embodiments of the present invention can also utilize chains, ropes, straps, and/or similar components in addition to or in place of those described above.

In some embodiments, the positioning of the bracket 122 can affect the playing experience of the user. In embodiments of the present invention, the position of the bracket 122 can be adjustable, such as vertically adjustable. In the specific embodiment shown, the bracket 122 is movable upward and downward, such as being slidable upward and downward. As shown in FIG. 3, the drum key screw 142 (or in other embodiments another type of device) can control the movement of the bracket 122. When the drum key screw 142 is loosened, the bracket 122 can be moved up or down. If the bracket 122 is in a lowered position, the pedal stop 123 may impact the bracket 122, such as the lower portion of the "L" or "C" in an L-shaped or C-shaped bracket upon a user releasing the pedal 108, causing the pedal 108 to immediately or nearly immediately stop its upward motion upon impact. A pedal in such a configuration does not have much, if any, rebound upon the pedal assembly 100 returning to its resting position. Such a configuration can also result in the pedal 108 being at a relatively lower angle when the pedal assembly 100 is in its resting position.

If, however, the bracket 122 is in a raised position as shown in FIG. 3, the bracket 122 is further from the pedal stop 123. This can result in more rebound or bounce of the pedal 108, such as after the pedal has reached its maximum angle and/or the pedal stop 123 has impacted the bracket 122 (such as the lower portion of the "L" in the L-bracket shown). In some such embodiments, the pedal stop 123 may not even be in contact with the bracket 122 when the system is at rest, allowing even more rebound and/or bounce for the pedal 108. For example, in some embodiments the bracket 122 can be adjusted such that the pedal 108 may actually rebound downward after reaching its maximum angle, such as due to spring action, instead of or in addition to contacting the bracket 122. Such a configuration can also result in the pedal 108 being at a relatively higher angle when the pedal assembly 100 is in its resting position, compared to the configuration described above with the bracket in a lowered position. It is understood that while a pedal stop 123 is described herein as a separate element, a portion of the link member or another element may serve the same purpose and be substituted for the pedal stop.

In one specific embodiment, when the bracket 122 is lowered, the hi-hat pedal assembly 100 is in a configuration such that there is less rebound and/or bounce, and/or when the bracket 122 is raised, the pedal assembly 100 is in a configuration allowing more rebound and/or bounce. In other embodiments it is understood that this can be reversed.

Additionally, positioning of the bracket 122 can have an impact upon the tension/resistance felt by a user when actuating the pedal 108. For instance, when the bracket 122 is in a higher position, the pedal 108 can be at a higher angle, and/or a compression spring within the system can be less compacted (and be longer) due to the top of the spring being moved higher, and thus the spring may offer less resistance when a user actuates the pedal 108. When the bracket 122 is in a lower position, the pedal 108 can be at a lower angle, and/or the compression spring within the system can be more compacted (and be shorter), and thus the spring may offer more resistance when a user actuates the pedal 108. It is also understood that similar concepts can be applied to a tension spring, where the raised or lowered position may result in more or less tension within the spring and, thus, the pedal offering more or less resistance. Further, while the above describes the bracket impacting the position of the top of the spring, other embodiments where it impacts the position of the bottom of the spring are also possible, as well as embodiments where it impacts the position of both the top and bottom of the spring.

The tension/resistance in the pedal 108 can also be adjusted by the raising or lowering of spring assembly 118. The spring assembly can include a substantially vertical portion and a substantially horizontal portion. A spring tension screw 112 and/or adjustment screw 136 can be loosened to allow for the raising or lowering of the spring assembly 118. Alternatively, the use of an adjustment screw can automatically raise or lower the spring assembly 118 based upon the screwing motion. Similar systems are described in U.S. patent application Ser. No. 14/495,718 to Sikra, entitled "Drum Pedal with Adjustment Features and Interlocking Features" and filed on Sep. 24, 2014, which is fully incorporated by reference herein in its entirety.

In one embodiment, raising the spring assembly 118 can result in increased pedal resistance and/or tension, and lowering the spring assembly 118 can decrease this resistance and/or tension. For example, in one embodiment, when the spring assembly 118 is raised to its highest position, the spring assembly 118 is configured so as to maximize resistance and/or tension in the pedal 108 (keeping all other variables constant), and the lowest position of the spring assembly 118 corresponds to the lowest resistance and/or tension in the pedal 108 (keeping all other variables constant). This can be due to the fact that, in one embodiment, raising the spring assembly 118, related spring bushing, and/or bottom of a compression spring (such as the spring bushing 262 and/or compression spring 260 in FIGS. 4 and 5 and previously described herein) can shorten the length of the compression spring when the pedal assembly is at rest, meaning that the compression spring provides more resistance upon pedal actuation (which shortens the compression spring even further, such as by lowering the top of the compression spring). This can be because as the spring assembly 118 is raised, the spring bushing or lower end of the spring can also be raised while the top of the spring remains stationary.

Similarly, lowering the spring assembly 118, bottom of a spring bushing, and/or bottom of a compression spring can increase the length of the compression spring when the pedal assembly is at rest, meaning the compression spring provides less resistance to compression upon pedal actuation. It is understood, however, that the relationship of position height and the corresponding tension levels may be inversed.

In one such example wherein the relationship of position height and pedal tension/resistance levels are inversed in relation to the specific embodiment described above, a tension spring is used instead of a compression spring, such that lowering of the spring assembly and corresponding lengthening of the tension spring results in more spring resistance upon actuation of the pedal, and/or raising of the bottom of the spring assembly and corresponding shortening of the tension spring results in less spring resistance upon pedal actuation.

Once a user has achieved the desired resistance level in the pedal 108, the spring tension screw 112 and/or adjustment screw 136 can be tightened to lock the spring assembly 118 in place. Alternatively, if the screwing motion itself raises and/or lowers the spring assembly 118, the spring assembly 118 may already be locked into place. Similar features are described in U.S. patent application Ser. No. 14/495,718 to Sikra, entitled "Drum Pedal with Adjustment Features and Interlocking Features" and filed on Sep. 24, 2014, which is fully incorporated by reference herein in its entirety.

In some embodiments, a heel plate 106 can be attached to the base plate 102 and/or a hinge piece 104. The hinge piece 104 can also be attached to base plate 102, or can be suspended over the base plate 102, such as between the heel plate 106 and the pedal 108. The heel plate 106 can also be flexible, such that it is referred to as a flexible heel plate. The heel plate 106 can be made of several different types of materials, such as metal. In some embodiments, the top of the heel plate 106 is separated from the bottom of the heel plate. The heel plate 106 can be several different shapes, such as a J-shape or a U-shape. In J-shape embodiments, the shorter end of the heel plate can be attached to base plate 102, while the longer end is attached to hinge piece 104. In these embodiments, the shorter end can be the bottom of the heel plate, while the longer end can be the top of the heel plate. The top of the heel plate 106 can flex in a downward manner when force is applied by a user. Further, suspension of the hinge piece 104 over the base plate 102 can add further flexibility to the heel plate 106. It is understood that in other embodiments, the heel plate 106 may not be flexible, and that the heel plate 106 can take various shapes.

The hi-hat pedal assembly 100 can also comprise interlocking features, such as interlocking features that can connect the base 102 to heel plate 106, heel plate 106 to hinge piece 104, and/or hinge piece 104 to pedal 108. Many pedal assemblies known in the art using conventional screw connections or other connections, such that some elements can begin to experience undesirable movement, which can be due to wear and tear. Moreover, undesired motion can also cause other problems, such as hinge lock-up based on bending of parts. The present invention can include interlocking features which can reduce or eliminate these problems. Some flexible heel plates and interlocking features which can be incorporated into embodiments of the present invention are discussed in commonly assigned U.S. application Ser. No. 14/495,718 to Sikra, which is fully incorporated by reference herein in its entirety.

In some embodiments, the hi-hat pedal assembly 100 can include a pedal incline adjustment feature. In these embodiments, the pedal 108 can be attached to a pedal attachment mechanism 130, which in turn can connect to the link member 132. As shown in FIG. 2, a connecting member 134 can connect the link member 132 to the pedal attachment mechanism 130. The connecting member 134 can be, for example, a pin, rod, screw, or other similar type of device; many different types of connecting members are possible. In one embodiment, the connecting member 134 can be a drum key screw or similar device placed through apertures in both the linking member 132 and the pedal attachment mechanism 130; when the drum key screw is loosened, its positioning within the pedal attachment mechanism 130 can be altered, whereas when the drum key screw is tightened, it is locked into position. In other embodiments, the connecting member 134 can be held in place by a drum key screw such as the drum key screw 116 (shown in FIGS. 1 and 3) or other similar device. It is understood that other screw or connections mechanisms besides such screws can be used, and it is understood that many different connection mechanisms are possible.

In some embodiments, the height of the connecting member 134 relative to the pedal attachment mechanism 130 can adjust the incline angle of pedal 108. In these embodiments, when the drum key 116 or similar is loosened, the height of the pedal attachment mechanism 130 can be adjusted such that the connecting member 134 is lower or higher within an aperture of the pedal attachment mechanism 130. When the drum key 116 is tightened, the connecting member 134 can be locked into place within the pedal attachment mechanism 134, which can set the incline angle of pedal 108. For example, when the connecting member 134 is in a lower position in relation to pedal attachment mechanism 130, pedal 108 can be at a higher incline angle. When the connecting member 134 is in a higher position in relation to pedal attachment mechanism 130, the pedal 108 can be at a lower incline angle. Other embodiments including the inverse of that described above are possible. The incline angle of pedal 108 can be adjusted to fit a user's needs and preferences. Further, this incline angle adjustment can be made independent of other features or characteristics in hi-hat pedal assembly 100, such as independent of the resistance offered by the pedal 108. Accordingly, the pedal incline adjustment feature of the present invention allows the pedal assembly 100 to be highly customizable.

According to some embodiments of the present invention, the pedal incline adjustment feature can be used in combination with a bracket such as the bracket 122 so that the pedal can be at the same angle whether the bracket 122 is at its maximum height or at its minimum height. Similarly, a tension adjustment feature such as the spring assembly 118 can be used in coordination with the bracket 122 such that a user can experience the same pedal resistance when the bracket 122 is at its maximum height or at its minimum height. Similarly, pedal angle and pedal resistance can be adjusted using, for example, the incline adjustment feature and the spring assembly 118 such that angle and resistance are the same when the bracket 122 is at its maximum height and at its minimum height. Pedal assemblies incorporating combinations of the features described herein can be highly customizable.

In some embodiments, the pedal assembly 100 can be held in place by securing means 150, such as spikes (although many different types of securing means including pillars, objects including roughened bottom surfaces, etc. are possible). The securing means 150 can be retractable within the rest of the pedal assembly, such as within the pedestal base plate 126*a* and/or the remainder of the pedestal 126. In one such embodiment, the securing means 150 are fully retractable within the remainder of the pedal assembly 100, although in other embodiments the securing means can be only partially retractable or not retractable. In some embodiments, the movement of another pedal assembly element, such as a drum key screw 152, can result in movement of the spikes 150. For example, when a drum key screw or similar device is loosened or tightened, a corresponding securing means 150 can move downward or move upward and retract, and vice versa. In other embodiments, the securing means 150 can be revealed or retracted without the use of drum key screws 152.

The securing means 150 can allow the hi-hat pedal assembly 100 to remain in place by engaging a surface or object under the pedal assembly 100. The use of spikes as a securing means, for example, can be particularly applicable to carpet surfaces. When the securing means 150 are lowered, they can engage the surface/object and hold the hi-hat pedal assembly 100 in place. Similarly, when the securing means 150 are raised, this can allow the pedal assembly 100 to be moved. It is understood that some embodiments of the pedal assembly 100 do not include the securing means 150 and/or drum key screws 152.

Figure 4:
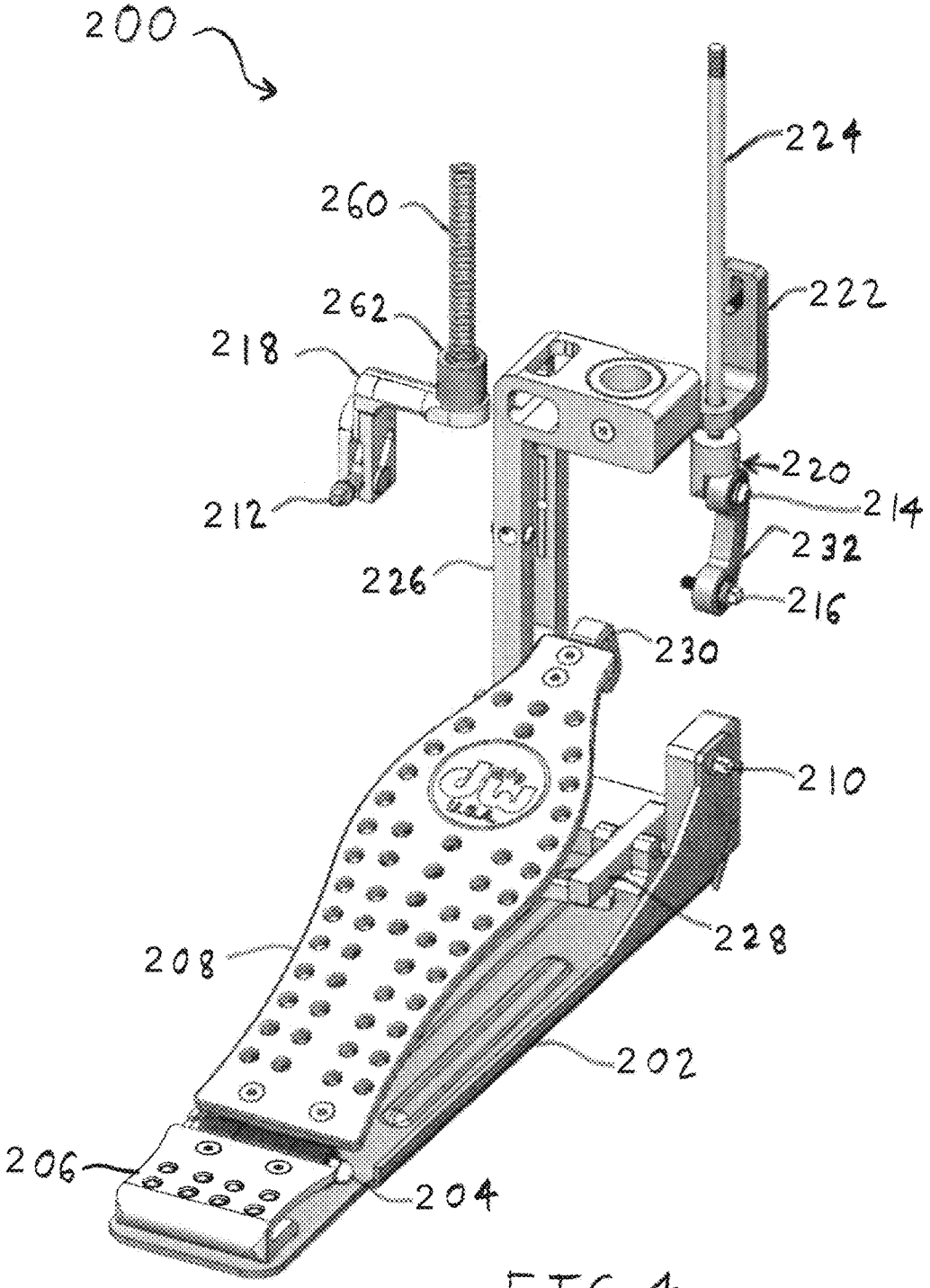
FIG. 4 is an exploded perspective view of another embodiment of a pedal assembly 200 according to the present invention.
Figure 5:
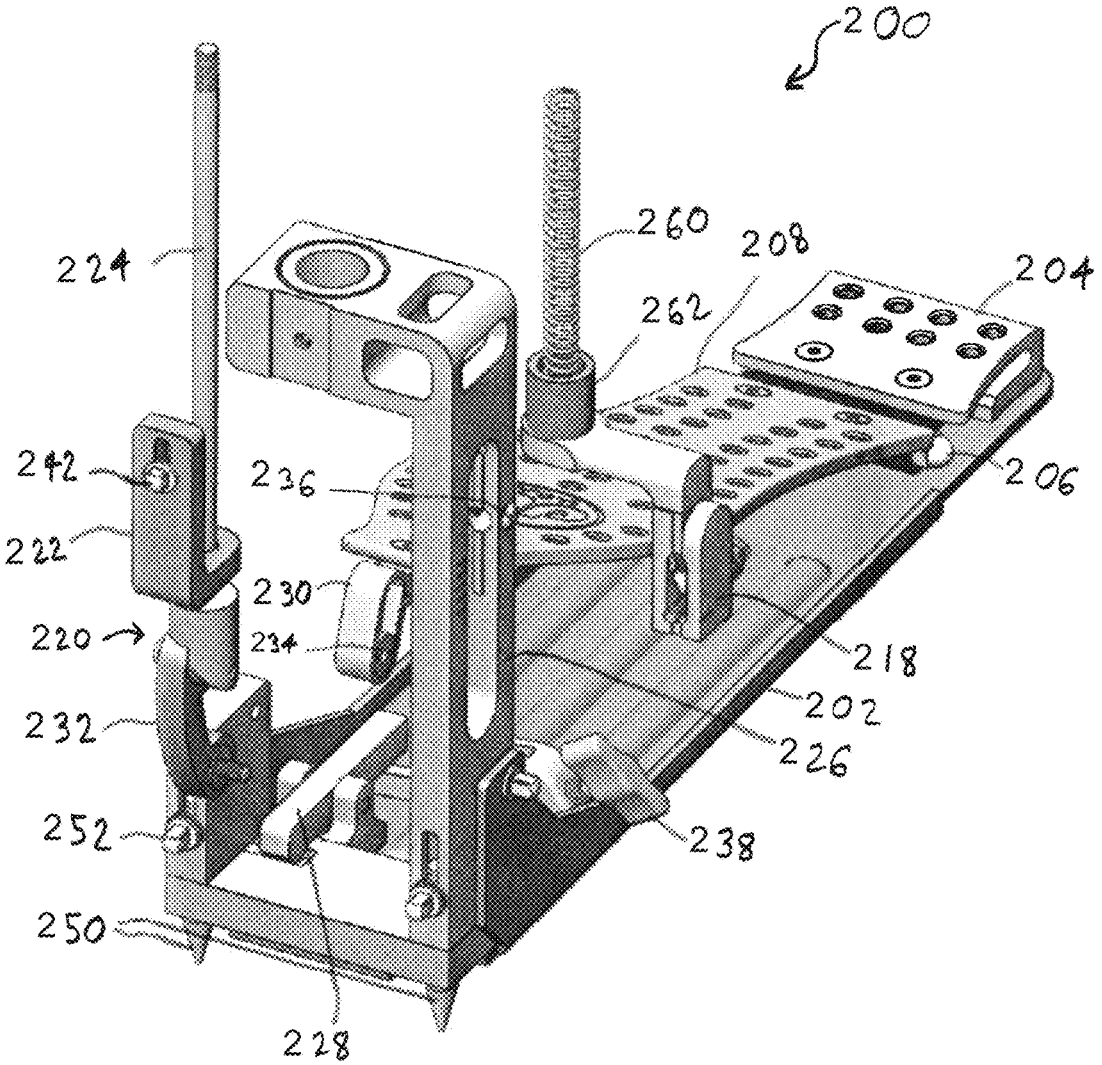
FIG. 5 is another exploded perspective view of the pedal assembly 200 according to the present invention.

FIGS. 4 and 5 are exploded perspective views of another embodiment of a pedal assembly 200 according to the present invention. The pedal assembly 200 can include components and/or features similar to or the same as those described above with regard to the pedal assembly 100. The hi-hat pedal assembly 200 can comprise a base plate 202, hinge piece 204, heel plate 206, pedal 208, drum key screws 210, spring tension screw 212, drum key screws 214, drum key screws 216, a spring assembly 218, a direct drive assembly 220, a bracket 222, a rod 224, a pedestal 226, a clamp locking assembly 228, a pedal attachment mechanism 230, a link member 232, a pin 234, an adjustment screw 236, a clamp screw 238, a drum key screw 242, securing means 250, drum key screws 252, a compression spring 260, and/or a spring bushing 262. These elements can be the same as or similar to corresponding elements described above with regard to FIGS. 1-3, or can be different and have different characteristics.

The compression spring 260 and/or spring bushing 262 can work separately and/or together with the spring assembly 218 to adjust the tension of the hi-hat pedal assembly 200. As described above with regard to the pedal assembly 100 shown in FIGS. 1-3, when the spring assembly 218 is raised or lowered, the length of the compression spring 260 and/or spring bushing 262 can be altered. In one embodiment, when the spring assembly 218 is raised, the height of the spring bushing 262 and/or the lower edge of the compression spring 260 is increased, which can increase the resistance felt by a user when actuating the pedal 208. In another embodiment, when the spring assembly 218 is lowered, the height of the spring bushing 262 and/or lower edge of the compression spring 260 is decreased, which can result in lengthening of the compression spring 260 and/or in the pedal 208 requiring more force to actuate. In some embodiments, the spring bushing 262 can be adjusted to increase and/or decrease the force in the compression spring 260. It is understood that the raising and/or lowering of the spring assembly 218 can correspond to either an increase and/or decrease in the force in the compression spring 260. It is further understood that a tension spring could replace the compression spring 260, with other components appropriately altered for operation with a tension spring. Such a system may operate in a manner different than that described above with regard to the FIGS. 4 and 5 embodiment incorporating a compression spring, and may operate in a manner similar to or the same as the tension spring embodiment described above with regard to FIGS. 1-3.

As mentioned previously, the adjustment of the spring assembly 218 can increase and/or decrease the resistance in the pedal 208. Moreover, such adjustments can increase and/or decrease the velocity with which the pedal 208 and/or other components return to resting position after an actuation. For example, embodiments where the pedal 208 offers more resistance to actuation may also have a relatively higher return velocity of the pedal 208, and embodiments where the pedal 208 offers less resistance to actuation may have a relatively lower return velocity of the pedal 208 (although it is understood that other embodiments are possible). Accordingly, the spring assembly 218, the compression spring 260 and/or the spring bushing 262, as well as any other component described herein, can work together and/or separately to adjust to a user's preferred pedal assembly characteristics.

It is understood that embodiments presented herein are meant to be exemplary. Embodiments of the present invention can comprise any combination of compatible features shown in the various figures, and these embodiments should not be limited to those expressly illustrated and discussed.

Although the present invention has been described in detail with reference to certain configurations thereof, other versions are possible. Therefore, the spirit and scope of the invention should not be limited to the versions described above.

The foregoing is intended to cover all modifications and alternative constructions falling within the spirit and scope of the invention as expressed in the appended claims, wherein no portion of the disclosure is intended, expressly or implicitly, to be dedicated to the public domain if not set forth in the claims.

I claim:

1. A pedal assembly for causing impact of two cymbals, the pedal assembly comprising:

a pedestal;

a pedal;

a rod connected to said pedal;

a compression spring operably connected to said pedal by said rod; and a spring assembly connected to said compression spring, said spring assembly comprising an adjustable portion, said adjustable portion comprising a vertically oriented portion within an aperture of said pedestal and further comprising a horizontally oriented portion attached to said vertically oriented portion, said compression spring on said horizontally oriented portion, said adjustable portion having a position that is adjustable so as to adjust a resting length of said compression spring.

2. The pedal assembly of claim 1, wherein the position of said adjustable portion is vertically adjustable.

3. The pedal assembly of claim 1, wherein said spring assembly comprises a spring bushing on said horizontally oriented portion; and wherein a bottom of said compression spring is on said spring bushing.

4. The pedal assembly of claim 3, wherein a position of said spring bushing is vertically adjustable.

5. The pedal assembly of claim 1, wherein said spring assembly is connected to a lower portion of said compression spring.

6. The pedal assembly of claim 5, wherein said rod is operably connected to said compression spring above where said spring assembly is connected to said compression spring, such that downward motion of said pedal causes downward motion of said rod and compression of said compression spring.

7. The pedal assembly of claim 1, further comprising a link member between said pedal and said rod.

8. The pedal assembly of claim 7, wherein said link member is rigid.

9. The pedal assembly of claim 1, wherein said spring assembly is connected to a bottom of said compression spring and said rod is connected to a top of said compression spring.

10. The pedal assembly of claim 9, further comprising a bracket attached to said pedestal, said bracket having a static position that is adjustable, wherein a downward adjustment of said static position of said bracket is configured to lower a resting angle of said pedal.

11. The pedal assembly of claim 1, wherein said vertically oriented portion and said horizontally oriented portion form substantially an inverted L-shape.

12. A pedal assembly for use with a percussion instrument, said pedal assembly comprising:

a pedal;

a compression spring;

a link member between said pedal and said compression spring;

a pedestal comprising a portion over said link member; and a bracket attached to said pedestal and comprising a bracket stop portion, said bracket stop portion between said link member and said compression spring;

wherein said bracket has a static position that is adjustable between a lowered position such that said pedal is at a relatively lower angle when at rest, and a raised position such that said pedal is at a relatively higher angle when at rest.

13. The pedal assembly of claim 12, wherein said bracket is shaped to define an aperture and said assembly further comprises a screw through said aperture, wherein said bracket is adjustable between said lower and raised positions when said screw is removed or in a loosened position and wherein said bracket is static when said screw is in a tightened position.

14. The pedal assembly of claim 12, further comprising a rod between said link member and said compression spring, wherein said rod passes through said bracket stop portion.

15. The pedal assembly of claim 12, wherein said static position of said bracket is vertically adjustable.

16. The pedal assembly of claim 14, further comprising a pedal stop between said link member and said bracket stop portion, said pedal stop connected to said link member.

17. The pedal assembly of claim 16, wherein said pedal stop is in contact with said bracket stop portion when said bracket is in said lowered position, and wherein said pedal stop is not in contact with said bracket stop portion when said bracket is in said raised position.

18. The pedal assembly of claim 12, wherein said bracket is substantially L-shaped.

19. A pedal assembly for causing impact of two cymbals, the pedal assembly comprising:

a pedestal comprising a pedestal vertical portion and a pedestal horizontal portion;

a spring adjustment mechanism comprising an adjustment vertical portion and an adjustment horizontal portion, said spring adjustment mechanism having a vertically adjustable position, and said adjustment horizontal portion being under said pedestal horizontal portion;

a compression spring through said pedestal horizontal portion and on said adjustment horizontal portion.

20. The pedal assembly of claim 19, wherein said adjustment vertical portion is within an aperture of said pedestal vertical portion.

21. The pedal assembly of claim 19, further comprising a rod through said adjustment horizontal portion, said pedestal horizontal portion, and said compression spring.

22. The pedal assembly of claim 19, further comprising a spring bushing on a top of said adjustment horizontal portion, said compression spring connected to said spring bushing.

23. The pedal assembly of claim 21, further comprising a pedal connected to said rod such that downward actuation of said pedal causes downward movement of said rod, and wherein said rod is connected to said compression spring such that downward movement of said rod causes compression of said compression spring.

* * * * *